US005135776A

United States Patent [19]

Okauchi et al.

[11] Patent Number: 5,135,776

[45] Date of Patent: Aug. 4, 1992

[54] METHOD FOR PRODUCING A HEAT-SENSITIVE RECORDING MATERIAL

[75] Inventors: Shuki Okauchi, Osaka; Kazuo Kojima, Sakai, both of Japan

[73] Assignee: Kanzaki Paper Manufacturing Co., Ltd., Tokyo, Japan

[21] Appl. No.: 544,331

[22] Filed: Jun. 27, 1990

[30] Foreign Application Priority Data

Jun. 30, 1989 [JP] Japan ..... 1-170899

[51] Int. Cl.[5] ..... B41M 5/30

[52] U.S. Cl. ..... 427/150; 503/207; 503/208; 503/209; 503/214

[58] Field of Search ..... 427/150–152; 503/208, 209, 225, 207, 214

[56] References Cited

U.S. PATENT DOCUMENTS 4,717,593 1/1988 Igarashi et al. ..... 427/150

*Primary Examiner*—Bruce H. Hess

*Attorney, Agent, or Firm*—Morgan & Finnegan

[57] ABSTRACT

A heat-sensitive recording material is obtained by coating an aqueous dispersion which is prepared by mixing an aqueous dispersion of an electron donating colorless dye with an aqueous dispersion of an electron accepting compound on a base sheet. The aqueous dispersion of an electron donating dye is prepared by a method which comprises the steps of uniformly dispersing at least one electron donating colorless dye and at least one heat-fusible substance selected from the group consisting of 2-benzyloxynaphthalene, parabenzyl biphenyl, 1,4-bis(2-vinyloxyethoxy)benzene, bis [2-(4-methoxyphenoxy)ethyl] ether, 1,2-bis (3-methylphenoxy)ethane, 1,2-diphenoxyethane, benzyl 4-methylthiophenyl ether, 1-(2-methylphenoxy)-2-(4-methoxyphenoxy)ethane and oxalic acid dibenzyl ester with a dispersing binder and/or a surface active agent in water; and pulverizing thus obtained dispersion with use of a horizontal sand mill.

6 Claims, 1 Drawing Sheet

METHOD FOR PRODUCING A HEAT-SENSITIVE RECORDING MATERIAL

FIELD OF THE INVENTION

This invention relates to an improved method for producing a heat-sensitive recording material by coating an aqueous dispersion containing an electron donating colorless dye and an electron accepting compound on a base sheet.

BACKGROUND AND OBJECT OF THE INVENTION

There has been well-known heat-sensitive recording materials which utilizing the colorforming reaction between a colorless or pale colored electron donating dye and an organic or inorganic electron accepting compound, in which color images are produced by heating to contact with each other of the electron donating dye and the electron accepting compound. Recently, a considerable progress has been made in the field of heat-sensitive recording systems, and heat-sensitive facsimiles, heat-sensitive printers and the like become possible to make the recording speed very higher. For example, in heat-sensitive facsimiles a recording speed of not more than 10 seconds for a sheet of A4 size can be achieved and in heat-sensitive printers a recording speed of 120 letters per second or more can be achieved. With the improvement of hardware fields as described above, it is required for the available heat-sensitive recording material to be superior in adaptability for a high-speed recording.

As means for improving the recording sensitivity of the heat-sensitive recording material, there has been a well-known method in which a heat-fusible material having a melting point lower than that of each of the electron donating dye and the electron accepting compound is added as shown in Japanese Laid-Open Patent Publication No. 34,842 of 1974, Japanese Laid-Open Patent Publication No. 39,139 of 1978 and the like. However, it is difficult to obtain one kind of the heat-fusible material which can dissolve both of the electron donating dye and the electron accepting compound. Further, when two or more kinds of heat-fusible materials are used together, there occurs such a problem as the initiation temperature of developing color is lowered by the depression of melting point owing to the eutectic phenomenon and resultantly the whiteness is lowered.

Furthermore, Japanese Laid-Open Patent Publication No. 15,394 of 1981 discloses a method for improving the record sensitivety of a heat-sensitive recording material by finely pulverizing the mixture of an electron donating dye, an electron accepting compound and a heat-fusible material. Japanese Laid-Open Patent Publication No. 69,089 of 1983 or U.S. Pat. No. 4,717,593 discloses a method for producing an improved heat-sensitive recording material in which a horizontal sand mill is used to finely pulverize an aqueous dispersion of an electron donating dye or an electron accepting compound. Additionally, Japanese Laid-Open Patent Publication No. 15, 394 of 1981 teaches that the pulverization degree of dye composition strongly effects upon the recording sensitivity of a heat-sensitive recording material.

However, it has been found that any particularly remarkable pulverizing effect can not be obtained even if a fatty acid amide which is a heat-fusible material used in the above methods is pulverized together with the dye with a horizontal sand mill. Further, when the particle size of media used in the horizontal sand mill is relatively large such as 1.0 mm to 3.0 mm, the pulverizing efficiency becomes bad. Therefore, those methods are not practical.

The dye, electron accepting compound and heat-fusible material used for producing a heat-sensitive recording material are generally used after pulverizing until the particle size is not more than a few microns. However, as described above, a remarkable improvement of the recording sensitivity is required with the remarkable speed-up of the recording instrument and the like and recently the requirement of the pulverization becomes strong.

The object of the invention is, therefore, to provide a method for producing a heat-sensitive recording material and particularly to a method for efficiently producing a heat-sensitive recording material superior in adaptability for a high-speed recording.

We have been studied methods for pulverizing the dye which affects the recording sensitivity, particularly methods for simultaneously pulverizing the dye and the heat-fusible material to obtain more improved recording sensitivity. Resultantly, it has been found that a great difference appears in the pulverizing efficiency by the kind of the heat-fusible materials used together with the dye. Particularly, the difference is remarkable in the case of the horizontal sand mill. Further, by widely studying the heat-fusible materials pulverized together with the dye and the pulverizing methods, it has been found that desired mixture dispersions having a volume average particle size of not more than 1.0 μm, preferably 0.5~1.0 μm, is obtained efficiently with use of a specific heat-fusible material in the condition of that the heat-fusible material is mixed with a dye dispersion and the dispersion is pulverized with a horizontal sand mill. In this way, the invention has been achieved.

SUMMARY OF THE INVENTION

According to the invention, a heat-sensitive recording material is obtained by coating an aqueous dispersion which is prepared by mixing an aqueous dispersion of an electron donating colorless dye with an aqueous dispersion of an electron accepting compound on a base sheet. It is characterized in that the aqueous dispersion of the electron donating colorless dye is prepared by a method which comprises the steps of uniformly dispersing at least one electron donating colorless dye and at least one heat-fusible material selected from the group consisting of 2-benzyloxynaphthalene, parabenzyl biphenyl, 1,4-bis(2-vinyloxyethoxy)benzene, bis [2-(4-methoxyphenoxy)ethyl] ether, 1,2-bis (3-methylphenoxy)ethane, 1,2-diphenoxyethane, benzyl 4-methylthiophenyl ether, 1-(2-methylphenoxy)-2-(4-methoxyphenoxy)ethane and oxalic acid dibenzyl ester with a dispersing binder and/or a surface active agent in water; and pulverizing thus obtained dispersion with use of a horizontal sand mill.

DETAILED DESCRIPTION OF THE INVENTION

The horizontal sand mill used in the invention is an apparatus in which a pulverizing vessel is horizontally arranged and charged with media, i.e., particles such as glass beads, zirconia, high-alumina ball, ceramics, steel ball, ottawa sand, flint stone and the like, and a stirring disc mounted on a horizontal revolving shaft is rotated with a high speed. In the horizontal sand mill, since the load put on the revolving shaft by the media is smaller than that in a perpendicular sand mill, the charging ratio of the media can be increased. For example, the charging ratio in a perpendicular sand mill is 70 to 80%, but the charging ratio in the horizontal sand mill is 80 to 90%. Resultantly, in the horizontal sand mill, a good pulverizing efficiency can be obtained.

Figure 1:
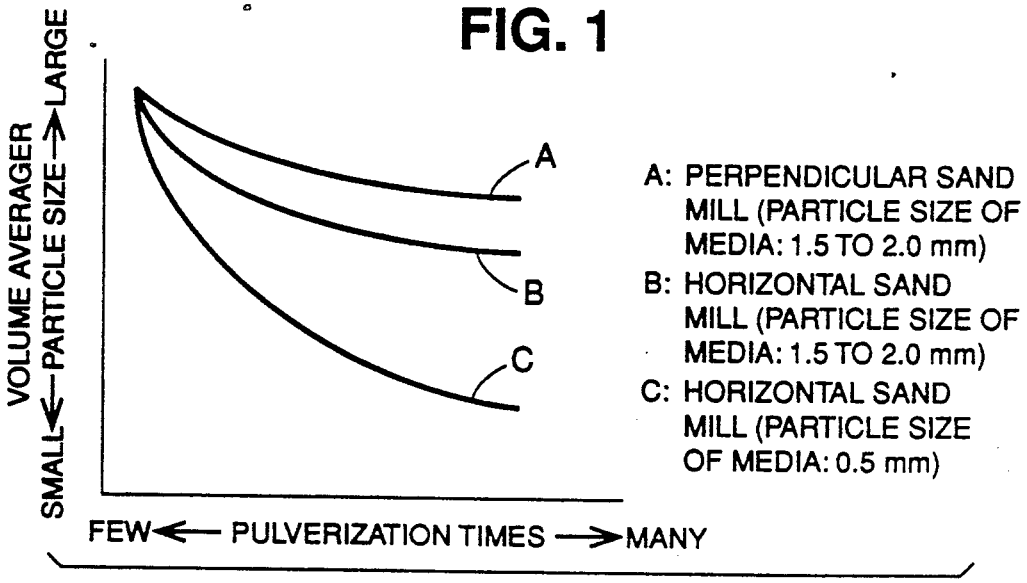
FIG. 1 is a graph illustrating the difference of pulverizing efficiency by the type of dispersing vessel and the particle size of media filled in the dispersing vessel.

Further, the particle size of the media contributes to the pulverizing efficiency and the pulverizing efficiency is further raised by use of relatively fine media as shown in FIG. 1.

The invention, in which the horizontal sand mill is used, is particularly characterized in that selectively defined heat-fusible materials are pulverized together with a dye. By widely studying the heat-fusible materials pulverized together with a dye to improve the recording sensitivity, it has been found that the pulverization efficiency very vary with the selected heat-fusible material, when it is pulverized with a dye. Particularly, the differencies are remarkable when the media charged in the horizontal sand mill are particles having a relatively small diameter of 0.3 mm to 1.0 mm, preferably 0.3 mm to 0.8 mm.

Thus selected heat-fusible materials according to the invention are 2-benzyloxynaphthalene, parabenzyl biphenyl, 1,4-bis(2-vinyloxyethoxy)benzene, bis [2-(4-methoxyphenoxy)ethyl] ether, 1,2-bis(3-methylphenoxy)ethane, 1,2-diphenoxyethane, benzyl 4-methylthiophenyl ether, 1-(2-methylphenoxy)-2-(4-methoxyphenoxy)ethane and oxalic acid dibenzyl ester. At least one of the heat-fusible materials is used together with a dye.

However, in the case of using a conventional heat-fusible material such as stearic acid amide, 2-(2'-hydroxy-5'-methylphenyl) benzotriazole or the like, it has been found that the pulverization efficiency is scarcely increased even if the horizontal sand mill charged with media consisting of small particles is used.

The amount of the heat-fusible material used together with a dye in the invention is preferably controlled in the range of 100 to 1,000 parts by weight, more preferably 200 to 500 parts by weight, per 100 parts of the dye.

Further, it has been found that the pulverization efficiency is more improved by roughly pulverizing the dispersion with a flow-type sand mill charged with media consisting of particles which have a particle size of 1.0 to 3.0 mm before the pulverizing step with the horizontal sand mill to obtain a dispersion in which the dispersed particles have a more uniform particle size and a sharper distribution.

Here the flow tube-type sand mill is an apparatus having a perpendicular or horizontal cylindrical vessel in which a shaft with discs or pins is set. Into the vessel charged with the media, a dispersion is continuously fed and pulverized. As the flow tube-type sand mill, there are exemplified sand grinder, grain mill, pearl mill, matter mill, dyno mill and the like.

Further, as the horizontal sand mill used in the invention, there are exemplified ULTRA VISCO MILL (Igarashi Kikai Seizo Co., Ltd.), AGITATOR MILL (Ashizawa Co., Ltd.), MECHAGAPER GRAIN MILL (Asada Iron Works Co., Ltd.), DYNO MILL (Willy. A. Bachofen Co., Ltd.) and the like, but, it is not limited to them.

As a dispersing binder used together with the heat-fusible material and dye in the invention, various kinds of water-soluble polymer having a dispersion ability can be used. Particularly, methyl celluloses, and polyvinylalcohols which have a polymerization degree of not less than 500, 0.1% aqueous solution of which has a surface tension of not more than 63 dyne/cm at 20° C., are preferably used. Further, with use of both of them, a very improved pulverization efficiency can be obtained. Among them, polyvinylalcohols having a polymerization degree of not less than 500, particularly 1000~3000, 0.1% aqueous solution of which has a surface tension of not more than 60 dyne/cm, particularly 40~56 dyne/cm at 20° C., are most preferably used.

Further, among the polyvinylalcohols having the above specific surface tension and polymerization degree, a polyvinylalcohol having the residual acetic acid group in the state of block is preferably used.

As the methyl celloses, there are exemplified methyl cellulose, hydroxypropylmethyl cellulose, hydroxyethylmethyl cellulose and the like. Methyl cellulose and hydroxypropylmethyl cellulose are preferable in terms of the pulverization efficiency. Particularly methyl celluloses, 2% aqueous solution of which has a viscosity of not more than 150 cps, preferably not more than 60 cps, at 20° C., are more preferably used.

Further, it has been found that the pulverization efficiency is more improved by controlling the high-shear viscosity of the dispersion to be pulverized within the range of 0.2 to 1.5 poise. If the high-shear viscosity is less than 0.2 poise, the effect of the used media is not obtained sufficiently and a long period is required in the pulverization step. On the contrary, if it is more than 1.5 poise, the heat-generation is large in the pulverization step and the dynamic load in stirring becomes high. Resultantly, it is recognized that the pulverization efficiency tends to lower.

Therefore, according to the invention, it is preferable to add 0. 2 to 10 parts by weight of the above specific polyvinylalcohol to 100 parts by weight of the dye and heat-fusible material. Particularly the added amount is preferable in the range of 1.0 to 5 parts by weight. Further, when a methyl cellulose is used together, it is preferably added in the range of 0.05 to 50 parts by weight, particularly 0.5 to 5 parts by weight per 1 part by weight of the polyvinylalcohol.

Further, to adjust the high-shear viscosity of the dispersion to 0.2 to 1.5 poise, there may be carried out not only controlling the added amount of polyvinylalcohols and methyl celluloses, but also controlling the solid concentration of the dispersion or adding the other additives may be added.

On the other hand, various surface active agents may be used to prepare the dispersion comprising of the dye and the specific heatfusible material. As the surface active agents, there are exemplified ester sulfate, alkyl sulfate, ether sulfate, alkyl ether sulfate, amide sulfate, sulfonated oil, alkyl sulfonate, dialkyl sulfosuccinate, ester sulfonate, alkylallyl and alkylnaphthalene sulfonate, formalin-condensationed naphthalene sulfonate, N-acyl sulfonate and the like.

The pulverization efficiency can be further improved by using the surface active agent together with the above dispersing binder. The surface active agent may be added to the dispersion before the roughly pulverizing step or between the roughly pulverizing step and the finely pulverizing step.

The added amount of the surface active agent is not particularly limited, but, it is generally controlled within the range of 0.05 to 20 parts by weight, preferably 0.1 to 5 parts by weight, per 100 parts by weight of the dye and heat-fusible material.

According to the invention, the dye is finely pulverized together with the heat-fusible material to improve the recording sensitivity. However, the electron accepting compound used with the dye in the preparation of the heat-sensitive recording material is also preferable to be pulverized by the same method as described above because the sensitization effect is raised by increasing the specific surface area of the particles.

As the electron donating dye used together with the specific heat-fusible substance in the invention, well-known various compounds may be used. There are exemplified triarylmethane compounds such as 3,3-bis(p-dimethylaminophenyl)-6-dimethylaminophthalide, 3,3-bis(p-dimethylaminophenyl)phthalide, 3-(p-dimethylaminophenyl)-3-(1,2-dimethylindole-3-yl)phthalide, 3-(p-dimethylaminophenyl)-3-(2-methylindole-3-yl)phthalide, 3,3-bis(1,2-dimethylindole-3-yl)-5-dimethylaminophthalide, 3,3-bis(1,2-dimethylindole-3-yl)-6-dimethylaminophthalide, 3,3-bis(9-ethylcarbazole-3-yl)-6-dimethylaminophthalide, 3,3-bis(2-phenylindole-3-yl)-6-dimethylaminophthalide, 3-p-dimethylaminophenyl-3-(1-methylpyrrole-3-yl)-6-dimethylaminophthalide and the like; diphenylmethane compounds such as 4,4'-bis-dimethylaminobenzhydryl benzyl ether, N-halophenyl-leucoauramine, N-2,4,5-trichlorophenyl-leucoauramine and the like; thiazine compounds such as benzoylleucomethylene blue, p-nitrobenzoyl-leucomethylene blue and the like; spiro compounds such as 3-methyl-spiro-dinaphthopyran, 3-ethyl-spiro-dinaphthopyran, 3-phenyl-spiro-dinaphthopyran, 3-benzyl-spiro-dinaphthopyran, 3-methyl-naphtho-(6'-methoxybenzo)spiropyran, 3-propyl-spiro-dibenzopyran and the like; lactam compounds such as Rhodamine-B-anilinolactam, Rhodamine(p-nitroanilino)lactam, Rhodamine(o-chloroanilino)lactam and the like; and fluoran compounds such as 3-dimethylamino-7-methoxyfluoran, 3-diethylamino-6-methoxyfluoran, 3-diethylamino-7-methoxyfluoran, 3-diethylamino-7-chlorofluoran, 3-diethylamino-6-methyl-7-chlorofluoran, 3-diethylamino-6,7-dimethylfluoran, 3-(N-ethyl-p-toluidino)-7-methylfluoran, 3-diethylamino-7-N-acetyl-N-methylaminofluoran, 3-diethylamino-7-N-methylaminofluoran, 3-diethyl-amino-7-dibenzylaminofluoran, 3-diethylamino-7-N-methyl-N-benzylaminofluoran, 3-diethylamino-7-N-chloroethyl-N-methylaminofluoran, 3-diethylamino-7-N-diethylaminofluoran, 3-(N-ethyl-p-toluidino)-6-methyl-7-phenylaminofluoran, 3-(N-ethyl-p-toluidino)-6-methyl-7-(p-toluidino)fluoran, 3-diethylamino-6-methyl-7-phenylaminofluoran, 3-dibutylamino-6-methyl-7-phenylaminofluoran, 3-dipentylamino-6-methyl-7-phenylaminofluoran, 3-diethylamino-7-(2-carbomethoxy-phenylamino)fluoran, 3-(N-ethyl-N-iso-amyl-)amino-6-methyl-7-phenylaminofluoran, 3-(N-cyclohexyl-N-methylamino)-6-methyl-7-phenylaminofluoran, 3-pyrrolidino-6-methyl-7-phenylaminofluoran, 3-piperidino-6-methyl-7-phenylaminofluoran, 3-diethylamino-6-methyl-7-xylidinofluoran, 3-diethylamino-7-(o-chlorophenylamino)fluoran, 3-dibutylamino-7-(o-chlorophenylamino)fluoran, 3-(N-ethyl-N-tetrahydrofurfuryl)amino-6-methyl-7-phenylaminofluoran, 3-(N-methyl-N-n-propyl)amino-6-methyl-7-phenylaminofluoran, 3-pyrrolidino-6-methyl-7-p-butylphenylaminofluoran, 3-(N-methyl-N-n-propyl)amino-6-methyl-7-phenylaminofluoran, 3-(N-ethyl-N-i-butyl)amino-6-methyl-7-phenylaminofluoran, 3-(N-methyl-N-n-hexyl-)amino-6-methyl-7-phenylaminofluoran, 3-(N-ethyl-N-n-hexyl)amino-6-methyl-7-phenylaminofluoran, 3-(N-ethyl-N-cyclopentyl)amino-6-methyl-7-phenylaminofluoran and the like. They may be solely or in combination.

Further, as the electron accepting compound, various compounds which develop a color in contacting with the above electron donating dye may be used. As the typical compounds, there are exemplified inorganic acidic materials such as activated clay, acid clay, attapulgite, bentonite, colloidal silica, aluminium silicate and the like; phenolic compounds such as 4-tert-butylphenol, 4-hydroxyphenoxide, α-naphthol, β-naphthol, 4-hydroxyacetophenol, 4-tert-octylcatechol, 2,2'-dihydroxydiphenol, 4,4'-isopropylidenebisphenol, 4,4'-sec-butylidenediphenol, 4-phenylphenol, 2,2'-methylenebis(4-chlorophenol), hydroquinone, 4,4'-cyclohexylidenediphenol, benzyl 4-hydroxybenzoate, dimethyl 4-hydroxyphthalate, hydroquinone monobenzyl ether, 3',4'-tetramethylene-4-hydroxydiphenylsulfone, 4-hydroxy-4'-isopropoxydiphenylsulfone, 4,4'-(1,3-dimethylbutylidene) bisphenol, 4,4'-(1-phenylethylidene)bisphenol, 4,4'-(p-phenylenediisopropylidene)diphenol, 4,4'-(m-phenylenediisopropylidene)diphenol, novolac-type phenolic compound, phenol polymer and the like; aromatic carboxylic acids such as benzoic acid, p-tert-butylbenzoate, trichlorobenzoate, terephthalic acid, 3-sec-butyl-4-hydroxybenzoate, 3-cyclohexyl-4-hydroxybenzoate, 3,5-dimethyl-4-hydroxybenzoate, salicylic acid, 3-isopropylsalicylate, 3-tert-butylsalicylate, 3-benzylsalicylate, 3-(α-methylbenzyl)salicylate, 3-chloro-5-(α-methylbenzyl)salicylate, 3,5-di-tert-butylsalicylate, 3-phenyl-5-(α,α-dimethylbenzyl)salicylate, 3,5-di-α-methylbenzylsalicylate and the like; salts of the above phenolic compounds or aromatic carboxylic acids with polyvalent metals such as zinc, magnesium, aluminum, calcium, titanium, manganese, tin and nickel; and organic acidic compounds such as complex consisting of salts of the polyvalent metals such as zinc, magnesium, aluminum, calcium, titanium, manganese, tin and nickel and the like with organic compounds such as antipyrine, pyridine, dimethylaminoantipyrine and the like.

The used amount of the above electron accepting compound and the electron donating compound is not particularly limited. However, the electron accepting compound is generally used within the range of 100 to 700 parts by weight, preferably 150 to 400 parts by weight, per 100 parts by weight of the basic chrmogenic material.

In the coating composition containing these compounds, there are included as the binder starches, hydroxyethylcellulose, methyl cellulose, carboxymethyl cellulose, gelatin, casein, gum arabic, polyvinyl alcohol, salts of styrene-maleic anhydride copolymer, salts of styrene-acrylic acid copolymer, styrene-butadiene copolymer emulsions and the like. They are used within the range of 10 to 40% by weight, preferably 15 to 30% by weight, on the basis of total solid amount.

Further, in the coating composition, there may be included various additives such as dispersing agents, e.g., sodium dioctylsulfosuccinate, sodium dodecylbenzenesulfonate, sodium lauryl sulfate and metal salts of fatty acid; antifoaming agents; fluorescent dyes; coloring dyes and the like. In the coating composition, the dispersion or emulsion of the compounds such as stearic acid, polyethylene, carnauba, paraffin wax, zinc stearate, calcium stearate, ester wax and the like may be added to prevent the sticking generated by the contact between heat-sensitive recording material and recording instrument or recording head.

Additionally, in the coating composition, there may be added retainability-modifiers such as 1,1,3-tris(2-methyl-4-hydroxy-5-tert-butylphenyl)butane, 1,1,3-tris(2-methyl-4-hydroxy-5-cyclohexylphenyl) butane, 1-[α-methyl-α-(4'-hydroxyphenyl)ethyl]-4-[α',α'-bis(4''-hydroxyphenyl)ethyl]benzene, 4,4'-butylidenebis(2-methyl-4-hydroxy-5-tert-butylphenyl) and the like, unless the desired effect of the present invention is inhibited.

There may be added inorganic pigments such as kaolin, clay, talc, calcium carbonate, calcined clay, titanium dioxide, diatom earth, finely divided anhydrous silica, activated clay and the like to prevent sticking smudges on a recording head.

As the base sheet, there may be used paper, plastic film, synthetic paper and the like, however, paper is most preferably used in terms of cost, coating ability and the like. The coating amount of the coating composition for the formation of the recording layer is not also limited, but it is generally controlled within the range of 2 to 12 g/m$^2$ by dry weight, preferably within the range of 3 to 10 g/m$^2$ by dry weight.

Further, an over-coating layer may be formed on the recording layer to protect the recording layer and so on, furthermore, a protect layer may be formed on the back of the base sheet. An undercoating layer may be naturally formed on the base sheet, and various known techniques in the field of manufacturing heat-sensitive recording materials may be applied.

Thus obtained heat-sensitive recording material according to the present invention is a heat-sensitive recording material having good recording sensitivity and excellent high-speed recordability.

PREFERRED EMBODIMENTS OF THE INVENTION

The following examples serve to illustrate the invention in more detail although the invention is not limited to the examples. Unless otherwise indicated, parts and % signify parts by weight and % by weight, respectively.

EXAMPLE 1

(1) Formation of an Under-coating Layer

The following composition was mixed with stirring to prepare a coating composition. The coating composition was coated on a wood free paper of 50 g/m$^2$ in the weight of an amount of 10 g/m$^2$ on dry basis and dried to obtain an under-coating layer.

| | |
|---|---|
| calcined clay (Trade name: Ansilex) (Ansilex (TM) manufactured by EMC Co., Ltd.) | 100 parts |
| styrene-butadiene copolymer latex (solid amount: 50%) | 14 parts |
| 10% aqueous solution of polyvinylalcohol | 30 parts |
| water | 200 parts |

-continued

(2) Preparation of Dispersion A

The following composition was mixed with stirring to obtain a uniform dispersion.

| | |
|---|---|
| 3-dibutylamino-6-methyl-7-phenylaminofluoran | 10 parts |
| 1,2-bis(3-methylphenoxy)ethane | 20 parts |
| 4,4'-butylidenebis(2-methyl-4-hydroxy-5-tert-butylphenyl) | 5 parts |
| 2% aqueous solution of methylcellulose (viscosity: 50 cps) | 20 parts |
| 2% aqueous solution of polyvinylalcohol (saponification degree: 88%, polymerization degree: 1,700, surface tention: 55 dyne/cm, residual acetic acid group: block type) | 20 parts |
| sodium di(tridecyl)sulfosuccinate | 1 part |
| water | 90 parts |

The dispersion was roughly pulverized by two times passing through a flow tube-type mill (SAND GRINDER 8G manufactured by Igarashi Kikai Seizo Co., Ltd., diameter of the pulverizing medium: 1.5 to 2.0 mm, packing ratio of the pulverizing medium: 75%, material of the pulverizing medium: glass, circular speed of rotor: 10 m/sec) at a flow rate of 200 l/HR. The volume average particle sizes after the first pulverization and the second pulverization were respectively 5.8 μm and 4.8 μm, and the respective standard deviations were 7.2 μm and 5.4 μm. Further, the dispersion were finely pulverized by 3 times passing through a horizontal sand mill (ULTRAVISCOMILL UVM-30 manufactured by Igarashi Kikai Seizo Co., Ltd., diameter of the pulverizing medium: 0.5 mm, packing ratio of the pulverizing medium: 85%, material of the pulverizing medium: zirconia, circular speed of rotor: 10 m/sec) at a flow rate of 100 l/HR. The volume average particle sizes after the third to fifth pulverizations were 2.3 μm, 1.01 μm and 0.72 μm respectively and the respective standard deviations were 2.23 μm, 0.92 μm and 0.65 μm.

(3) Preparation of Dispersion B

The following composition was mixed with stirring to obtain a uniform dispersion.

| | |
|---|---|
| 4-hydroxy-4'-isopropoxydiphenylsulfone | 30 parts |
| 2% aqueous solution of methylcellulose (viscosity: 50 cps) | 20 parts |
| 2% aqueous solution of polyvinylalcohol (saponification degree: 88%, polymerization degree: 1,700, surface tention: 55 dyne/cm, residual acetic acid group: block type) | 20 parts |
| sodium dioctylsulfosuccinate | 1 part |

The dispersion was roughly pulverized 2 times with use of the same flow tube-type mill as used in the preparation of Dispersion A. The volume average particle sizes after the first pulverization and the second pulverization were 5.1 μm and 3.9 μm respectively and the respective standard deviations were 8.5 μm and 5.5 μm. Further, the dispersion was finely pulverized 2 times with use of the same horizontal sand mill as used in the preparation of Dispersion A. The volume average particle sizes after the pulverizations were 2.0 μm and 0.8

μm respectively and the respective standard deviations were 2.3 μm and 0.9 μm.

The above volume average particle sizes were measured with COLTER MULTISIZER manufactured by Colter Counter Co., Ltd.

(4) Formation of a Heat-sensitive Recording Material

166 Parts of Dispersion A, 71 parts of Dispersion B, 30 parts of silicone dioxide pigment (oil absorption: 180 cc/100 g), 150 parts of 20% aqueous solution of oxidized starch, 200 parts of water were mixed and stirred to obtain a coating composition. The obtained coating composition was coated on the above under-coating layer in an amount of 5.0 g/m$^2$ on dry basis, and dried to obtain a heat-sensitive recording material.

EXAMPLES 2~9 AND COMPARATIVE EXAMPLES 1~2

Heat-sensitive recording materials were obtained in the same manner as in Example 1 except that the following compounds were used as a heat-fusible material instead of 1,2-bis(3-methylphenoxy)ethane to prepare Dispersion A.

Example 2: 2-benzyloxynaphthalene
Example 3: parabenzylbiphenyl
Example 4: 1,4-bis(2-vinyloxyethoxy)benzene
Example 5: bis[2-4(methoxyphenoxy)ethyl]ether
Example 6: 1,2-diphenoxyethane
Example 7: benzyl-4-methylthiophenylether
Example 8: 1-(2-methylphenoxy)-2-(4-methoxyphenoxy)ethane
Example 9: oxalic acid dibenzyl ester
Comparative Example 1; stearic acid amide
Comparative Example 2; 2-(2'-hydroxy-5'-methylphenyl) benzotriazole

COMPARATIVE EXAMPLE 3

A heat-sensitive recording material was obtained in the same manner as in Example 1 except that the third to fifth pulverization steps for preparing Dispersion A were carried out with the same flow tube-type mill (SAND GRINDER 8G) as used in the first and second pulverization steps at a flow rate of 100 l/HR.

COMPARATIVE EXAMPLE 4

A heat-sensitive recording material was obtained in the same manner as in Comparative Example 3 except that stearic acid amide was used as a heat-fusible material instead of 1,2-bis(3-methylphenoxy) ethane to prepare Dispersion A.

The volume average particle size and the standard deviation of thus obtained Dispersion A of each of Examples and Comparative Examples are shown in Table-1. The pulverization condition of Dispersion A in the typical Examples and Comparative Examples is shown in FIG. 2.

Further, on thus obtained 13 heat-sensitive recording materials, there were recorded color images with use of a heat-sensitive simulator manufactured by Kyoto Ceramic Kabushiki Kaisha (voltage: 16 V, pulse cycle: 5 msec) under the condition that the pulse width is 0.30 msec, and then the density of the recorded images was measured by Macbeth densitometer RD-100R type manufactured by Macbeth Corp. with use of an amber filter. The obtained results are shown in Table-1.

Figure 2:
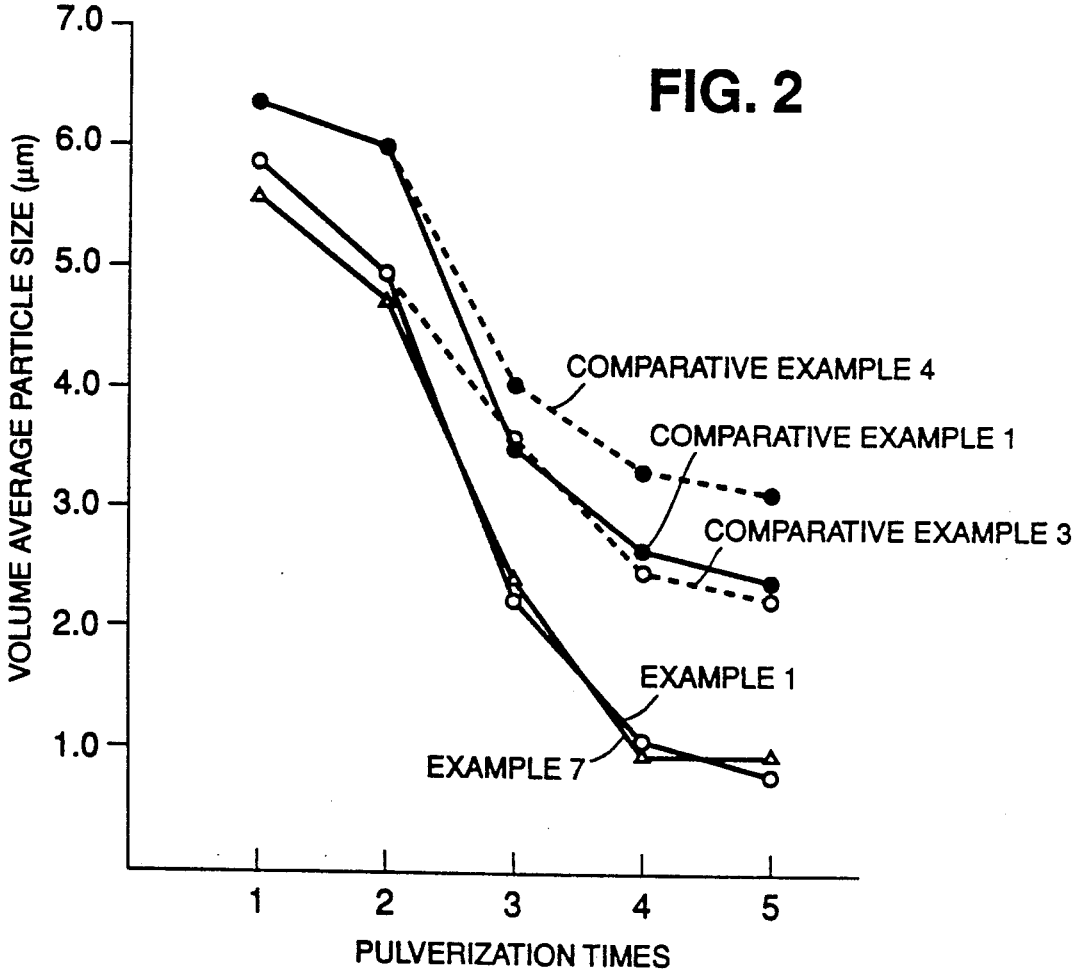
FIG. 2 is a graph illustrating the pulverization condition of aqueous dispersions comprising a heat-fusible material with a dye of typical Examples and Comparative Examples.

As shown in Table-1 and FIG. 2, the heat-sensitive recording materials obtained by use of the developing material which is pulverized finely according to the present invention had good recording sensitivity and excellent high-speed recordability.

TABLE 1

| | Volume average particle size (μm) Pulverization steps (times) | | | | | Standard deviation (μm) Pulverization steps (times) | | | | | Optical density of recorded images |
|---|---|---|---|---|---|---|---|---|---|---|---|
| | 1 | 2 | 3 | 4 | 5 | 1 | 2 | 3 | 4 | 5 | |
| Example | | | | | | | | | | | |
| 1 | 5.81 | 4.82 | 2.33 | 1.10 | 0.72 | 7.21 | 5.40 | 2.23 | 0.92 | 0.65 | 1.15 |
| 2 | 5.72 | 4.79 | 2.12 | 1.00 | 0.80 | 6.62 | 5.33 | 2.25 | 0.90 | 0.72 | 1.08 |
| 3 | 5.50 | 4.21 | 2.09 | 1.08 | 0.92 | 6.30 | 5.12 | 2.10 | 0.92 | 0.77 | 1.09 |
| 4 | 5.62 | 4.33 | 2.00 | 0.98 | 0.70 | 6.90 | 5.55 | 2.05 | 0.95 | 0.65 | 1.14 |
| 5 | 5.85 | 4.83 | 2.31 | 1.00 | 0.70 | 6.75 | 5.01 | 2.15 | 0.90 | 0.63 | 1.13 |
| 6 | 5.77 | 4.77 | 2.20 | 0.99 | 0.70 | 7.22 | 5.21 | 2.17 | 0.92 | 0.64 | 1.19 |
| 7 | 5.51 | 4.72 | 2.43 | 0.91 | 0.80 | 7.15 | 5.18 | 2.33 | 0.92 | 0.73 | 1.23 |
| 8 | 5.58 | 4.67 | 2.30 | 0.90 | 0.85 | 7.20 | 5.16 | 2.10 | 0.91 | 0.61 | 1.25 |
| 9 | 5.80 | 4.82 | 2.40 | 1.08 | 0.90 | 7.18 | 5.42 | 2.33 | 0.95 | 0.75 | 1.24 |
| Comparative Example | | | | | | | | | | | |
| 1 | 6.32 | 5.91 | 3.52 | 2.73 | 2.41 | 8.25 | 6.42 | 4.42 | 3.05 | 2.95 | 0.65 |
| 2 | 6.81 | 5.81 | 3.61 | 2.92 | 2.51 | 8.55 | 6.38 | 5.10 | 3.15 | 2.75 | 0.72 |
| 3 | 5.81 | 4.82 | 3.60 | 2.43 | 2.22 | 7.21 | 5.40 | 4.45 | 2.95 | 2.67 | 0.95 |
| 4 | 6.32 | 5.91 | 4.00 | 3.32 | 3.11 | 8.25 | 6.42 | 4.87 | 2.75 | 2.65 | 0.58 |

What we claim is:

1. A method for producing a heat-sensitive recording material by coating an aqueous dispersion which is prepared by mixing an aqueous dispersion of an electron donating colorless dye with an aqueous dispersion of an electron accepting compound on a base sheet, characterized in that the aqueous dispersion of the electron donating colorless dye is prepared by a method comprising the steps of: uniformly dispersing at least one electron donating colorless dye and at least one heat-fusible substance selected from the group consisting of 2-benzyloxynaphthalene, parabenzyl biphenyl, 1,4-bis(2-vinyloxyethoxy)benze, bis[2-(4-methoxyphenoxy)ethyl]ether, 1,2-bis(3-methylphenoxy)ethane, 1,2-diphenoxyethane, benzyl 4-methylthiophenyl ether, 1-(2-methylphenoxy)-2-(4-methoxyphenoxy)ethane and oxalic acid dibenzyl ester with a dispersing binder and/or a surface active agent in water; and finely pulverizing thus obtained dispersion with use of a horizontal sand mill.

2. A method as defined in claim 1, in which said horizontal sand mill is charged with media which are particles having a particle size of 0.3 mm to 1.0 mm.

3. A method as defined in claim 2, in which said dispersion is roughly pulverized with use of a flow tube-type mill charged with media which are particles having a particle size of 1.0 mm to 3.0 mm before finely pulverizing with said horizontal sand mill.

4. A method as defined in claim 1 or 2, in which said dispersion is finely pulverized with said horizontal sand mill until the average volume particle size becomes not more than 1.0 μm.

5. A method as defined in claim 1 or 2, in which at least one selected from the group consisting of methyl celluloses, and polyvinylalcohols which has a polymerization degree of not less than 500 and 0.1% aqueous solution of which has a surface tension of not more than 63 dyne/cm at 20° C. is used as a dispersing binder.

6. A method as defined in claim 1 or 2, in which said electron accepting compound is uniformly dispersed with a dispersing binder and/or a surface active agent in water and then the dispersion is finely pulverized with use of said horizontal sand mill.

* * * * *

UNITED STATES PATENT AND TRADEMARK OFFICE

CERTIFICATE OF CORRECTION

PATENT NO. : 5,135,776

DATED : August 4, 1992

INVENTOR(S) : Shuki Okauchi and Kazuo Kojima

It is certified that error appears in the above-identified patent and that said Letters Patent is hereby corrected as shown below:

IN THE CLAIMS:

Claim 1, Column 10, line 55, cancel "benze" and in place thereof insert -- benzene --.

Signed and Sealed this

Sixteenth Day of November, 1993

Bruce Lehman

*Attest:*

BRUCE LEHMAN

*Attesting Officer*

*Commissioner of Patents and Trademarks*